United States Patent [19]

Maxey

[11] 4,004,378

[45] Jan. 25, 1977

[54] GRINDING WHEEL WITH INTEGRAL BLOWER

[75] Inventor: Van Q. Maxey, Morgan Hill, Calif.

[73] Assignee: Engelhard Minerals & Chemicals Corporation, Murray Hill, N.J.

[22] Filed: July 18, 1975

[21] Appl. No.: 597,021

[52] U.S. Cl. ..... 51/273; 51/206 R; 51/356

[51] Int. Cl.[2] ..... B24B 55/06; B24D 5/10

[58] Field of Search ..... 51/356, 206 R, 207, 51/266, 273

[56] References Cited

UNITED STATES PATENTS

| | | | |
|---|---|---|---|
| 2,236,232 | 3/1941 | Brescka et al. | 51/270 |
| 2,814,171 | 11/1957 | Bogart | 51/273 |
| 3,145,511 | 8/1964 | Bird et al. | 51/266 X |
| 3,406,489 | 10/1968 | Harris | 51/356 |
| 3,420,010 | 1/1969 | Tobey | 51/356 |
| 3,579,928 | 5/1971 | Held | 51/356 |
| 3,754,359 | 8/1973 | Scandaletos | 51/356 |
| 3,916,579 | 11/1975 | Waller | 51/356 X |

*Primary Examiner*—Al Lawrence Smith
*Assistant Examiner*—Nicholas P. Godici

[57] ABSTRACT

A grinding wheel functions both as an abrasive wheel and as a blower for removing dust and cooling the workpiece and wheel. The wheel has passageways through which air and dust are drawn from one axially facing side of the wheel to the other as the wheel rotates. A shroud partly encloses the wheel, and means is provided for catching dust from the workpiece and holding the dust in position to be drawn through the wheel by air passing therethrough. An exhaust duct is provided for carrying the dust and air passing through the wheel away from the wheel.

9 Claims, 4 Drawing Figures

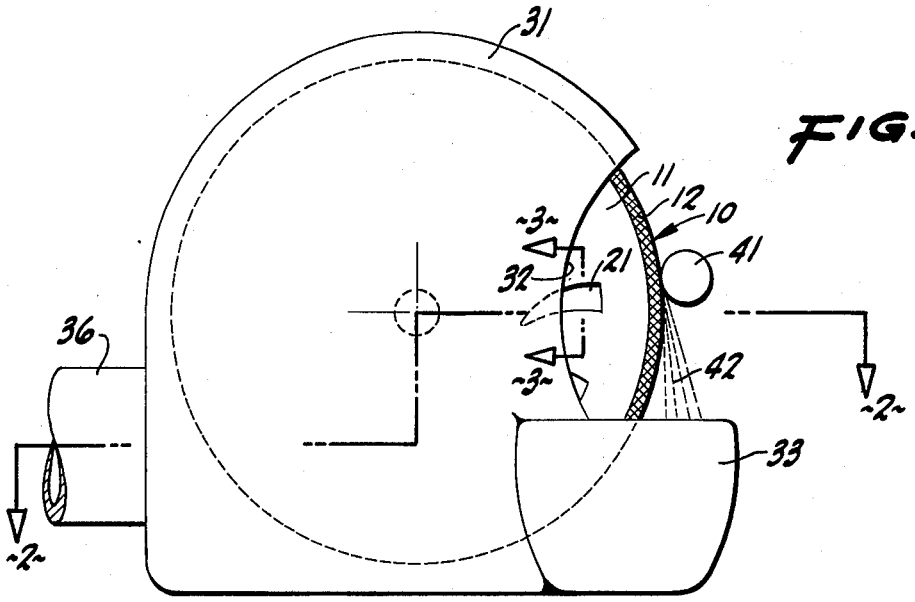
FIG-1
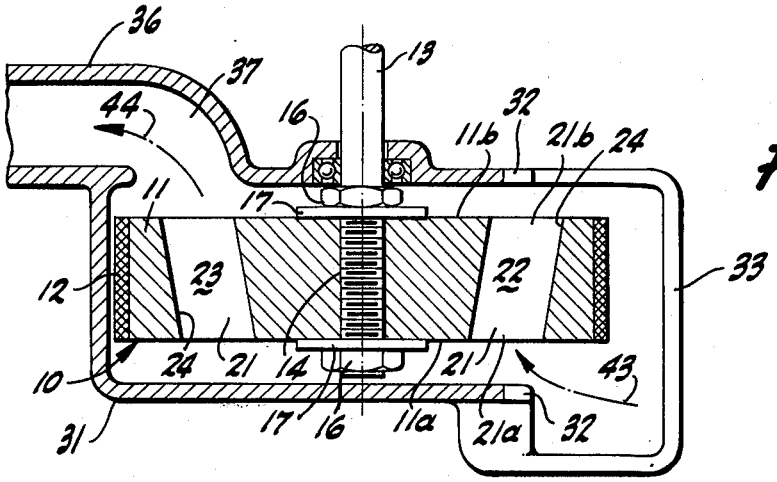
FIG-2
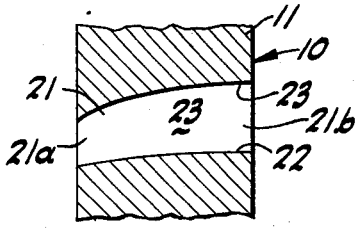
FIG-3
FIG-4
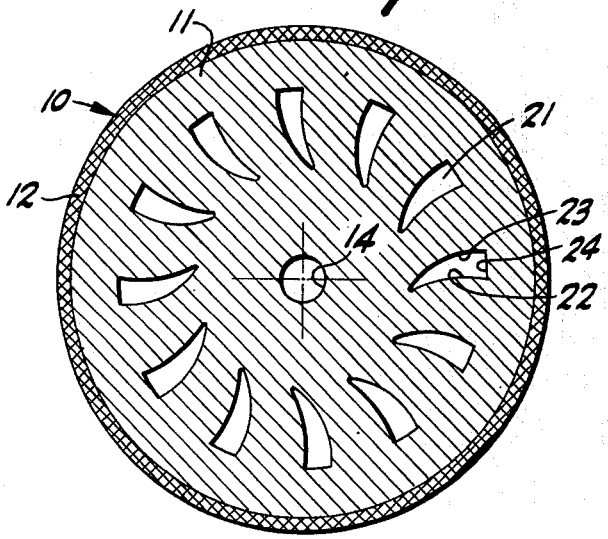

GRINDING WHEEL WITH INTEGRAL BLOWER

BACKGROUND OF THE INVENTION

This invention pertains generally to abrading machines and more particularly to grinding apparatus and wheels.

In centerless grinders and other grinding apparatus of the prior art, liquid coolants or grinding fluids are commonly applied to the point of contact between the grinding wheel and workpiece to dissipate the heat generated by the grinding process and to contain the dust from the wheel and workpiece. In the grinding of materials such as nuclear fuel pellets containing plutonium, uranium oxide, beryllia and similar materials, the dust presents a particularly serious problem and must be carefully contained.

SUMMARY AND OBJECTS OF THE INVENTION

The invention provides a grinding wheel which functions both as an abrasive wheel and as a blower for removing dust and cooling the workpiece and wheel. The wheel has blower passageways through which air and dust are drawn from one axially facing side of the wheel to the other as the wheel rotates. A shroud partially encloses the wheel, and means is provided for catching dust from the workpiece and holding the dust in position to be drawn through the wheel by air passing therethrough. An exhaust duct carries the dust and air passing through the wheel away from the wheel.

It is in general an object of the invention to provide a new and improved grinding wheel.

Another object of the invention is to provide a grinding wheel of the above character in which blower passageways are provided for passing air and dust through the wheel in a generally axial direction from one side of the wheel to the other.

Additional objects and features of the invention will be apparent from the following description in which the preferred embodiment is set forth in detail in conjunction with the accompanying drawings.

BRIEF DESCRIPTION OF THE DRAWINGS

FIG. 1 is a side elevational view of one embodiment of grinding apparatus according to the invention.

FIG. 2 is a cross-sectinal view taken along line 2—2 in FIG. 1 and rotated 9°.

FIG. 3 is fragmentary cross-sectional view taken along line 3—3 in Fig. 1.

FIG. 4 is a vertical sectional view of the grinding wheel of the embodiment of FIG. 1.

DETAILED DESCRIPTION

As illustrated, the grinding wheel 10 includes a generally cylindrical inner hub portion 11 and an abrasive peripheral portion 12. The hub portion is fabricated of a rigid material such as phenolic, aluminum, alumina, steel, stainless steel or another suitable resin, ceramic or metal, and the abrasive portion is bonded to the outer periphery of the hub portion. The abrasive portion comprises a suitable abrasive such as a diamond matrix having a plurality of diamonds embedded in a suitable bonding material such as epoxy.

The wheel is mounted on a threaded spindle 13 which can, for example, be the shaft of a drive motor, not shown. The spindle extends through an axial bore 14 in the hub portion of the wheel, and the wheel is secured to the spindle by nuts 16 and washers 17.

Hub portion 12 is formed to include at least one blower passageway 21 extending in a direction generally parallel to the axis of the wheel for drawing air and dust from a workpiece through the wheel as the wheel is rotated. Each of the passageways includes intersecting side walls 22, 23 and an outer wall 24. Each passageway has an inlet end **21*a* opening through a first axially facing side 11*a* of the wheel and an outlet end 21*b* opening through a second axially facing side of 11*b* of the wheel. The passageways are inclined in an outward direction, with the outlet ends being farther from the axis of the wheel than the inlet ends, as best seen in FIG. 2. Walls 22 and 23 are arcuate, and they diverge toward the outlet ends to facilitate the flow of air through the passageways in the desired direction, with wall 23 being longer than wall 22**. The passageways are spaced uniformly about the axis of the wheel.

A shroud 31 surrounds and encloses most of the grinding wheel, although a portion of the shroud is cut away, as indicated at 32, to provide access to the wheel for a workpiece. The shroud is formed to include a dust well 33 catching dust from the wheel and workpiece and holding the dust in position to be drawn into the inlet ends of blower passageways 21. For this purpose, the well extends farther on the inlet side of the wheel than the outlet side to facilitate the movement of the dust toward this side. An exhaust duct 36 is provided on the outlet side of the wheel an communicates with the interior of the shroud on this side of the wheel through an exhaust port 37. The shroud can be constructed in two or more pieces, as desired, to facilitate installation and removal of the wheel.

Operation and use of the invention can be described briefly. It is assumed that shaft 13 is connected to a suitable motor or other means for driving the wheel in the clockwise direction, as viewed in FIG. 1. A workpiece 41 supported by a suitable tool rest or knife edge, not shown, is brought into contact with the outer periphery of the rotating wheel. Material removed from the workpiece is delivered to well 33 by the spinning action of the wheel, as indicated at 42, together with some abrasive dust from the wheel itself.

As the wheel rotates, air is drawn into passageways 21 from the inlet side **11*a* of the wheel, as indicated by arrow 43, and discharged from the other side of the wheel through exhaust duct 36, as indicated by arrow 44. As the air enters the passageways, the dust from the workpiece and wheel in well 33 is entrained therein, and this dust is drawn through the wheel and blown out of the machine through exhaust duct 36**. In addition to removing the dust, the air passing through the wheel serves to cool the wheel and workpiece, eliminating the need for liquid coolants.

The invention has a number of important features and advantages. The work wheel serves both as a grinding wheel and as a blower, and the air which passes through the wheel serves to remove the abrasive and workpiece duct from the machine and to cool both the wheel and the workpiece. With the invention, dry grinding of materials such as nuclear fuel pellets is possible, and the dust from such materials is contained effectively.

The number, size, location and shape of the passageways can be chosen to suit particular applications. However, it is generally desirable that the passageways be spaced symmetrically about the axis of the wheel to provide proper balance as the wheel rotates.

It is apparent from the foregoing that a new and improved grinding machine and wheel have been provided. While only the preferred embodiment has been described, as will be apparent to those familiar with the art, certain changes and modifications can be made without departing from the scope of the invention as defined by the following claims.

I claim:

1. In grinding apparatus: a rotatively mounted wheel comprising a generally cylindrical inner portion and an abrasive cutting portion disposed coaxially of the inner portion for removing material from a workpiece engaged by the outer periphery of the wheel, the inner portion being formed to include at least one blower passageway extending through the wheel in a generally axial direction for directing air and material removed from the workpiece through the wheel from a first side to a second side as the wheel rotates in a predetermined direction, means defining a well for catching material removed from the workpiece and holding said material in position to be drawn into the blower passageway, a shroud partly enclosing the wheel, and an exhaust port communicating with the interior of the shroud and positioned for receiving the air and material delivered to the second side of the wheel and carrying said air and material from the machine, whereby rotation of the wheel causes air to be drawn from one side of the wheel to the opposite side of the wheel carrying the material from the well to the exhaust port.

2. The grinding machine of claim 1 wherein the wheel includes a plurality of blower passageways spaced symmetrically about the axis of rotation.

3. The grinding apparatus of claim 1 wherein the blower passageway includes a pair of outwardly diverging arcuate side walls intersecting along a line inclined relative to the axis and an outer wall adjoining the side walls to form inlet and outlet openings at the first and second sides of the wheel, the outlet opening being spaced farther from the axis than the inlet opening.

4. The grinding wheel of claim 3 wherein the side walls of the passageway also diverge toward the outlet opening, whereby the outlet opening is wider than the inlet opening.

5. In a grinding wheel for removing material from a workpiece engaged by the outer periphery of the wheel: a generally cylindrical inner portion adapted to be rotated about its axis, an abrasive cutting portion disposed coaxially of the inner portion and defining the outer periphery of the wheel, and at least one blower passageway having a continuous wall extending in an axially inclined direction between axially spaced sides of the wheel for drawing air and material removed from the workpiece through the wheel when the wheel is rotated in a predetermined direction, said passageway being spaced inwardly of the outer periphery and opening through the sides of the wheel without opening through the periphery.

6. The grinding wheel of claim 5 wherein a plurality of blower passageways are spaced uniformly about the axis of the wheel.

7. In a grinding wheel for removing material from a workpiece engaged by the outer periphery of the wheel: a generally cylindrical inner portion adapted to be rotated about its axis, an abrasive cutting portion disposed coaxially of the inner portion and defining the outer periphery of the wheel, and at least one blower passageway extending between axially spaced sides of the wheel for drawing air and material removed from the workpiece through the wheel when the wheel is rotated in a predetermined direction, the blower passageway including a pair of outwardly diverging arcuate side walls intersecting along a line inclined relative to the axis and an outer wall adjoining the side walls to form inlet and outlet openings on opposite sides of the wheel, the outlet opening being spaced farther from the axis than the inlet opening.

8. The grinding wheel of claim 7 wherein the side walls of the passageway also diverge toward the outlet opening, whereby the outlet opening is wider than the inlet opening.

9. The grinding wheel of claim 3 wherein the abrasive cutting portion includes diamonds.

* * * * *